United States Patent [19]

Salomon

[11] 4,003,587

[45] Jan. 18, 1977

[54] SAFETY BINDING FOR SKI BOOTS

[75] Inventor: Georges Pierre Joseph Salomon, Annecy, France

[73] Assignee: Etablissements Francois Salomon et Fils, Annecy, France

[22] Filed: July 3, 1975

[21] Appl. No.: 593,056

[30] Foreign Application Priority Data

July 3, 1974 France ..... 74.23190

[52] U.S. Cl. ..... 280/637; 280/618; 280/623

[51] Int. Cl.[2] ..... A63C 9/081

[58] Field of Search ..... 280/11.35 N, 11.35 K, 280/11.35 Y, 11.35 R, 11.35 T, 637, 618, 620, 623

[56] References Cited

UNITED STATES PATENTS

| | | | |
|---|---|---|---|
| 3,612,559 | 10/1971 | Petersen | 280/11.35 T |
| 3,764,155 | 10/1973 | Perryman | 280/11.35 Y |
| 3,822,070 | 7/1974 | Salomon | 280/11.35 N |
| 3,825,274 | 7/1974 | Weinstein | 280/11.35 N |
| 3,844,575 | 10/1974 | Salomon | 280/11.35 N |
| 3,845,964 | 11/1974 | Johnson | 280/11.35 K |
| 3,874,685 | 4/1975 | von Besser | 280/11.35 N |
| 3,909,029 | 9/1975 | Salomon | 280/11.35 T |

*Primary Examiner*—M. H. Wood, Jr.
*Assistant Examiner*—David M. Mitchell

[57] ABSTRACT

A safety binding for ski boots comprising: a first holding element, mobile in relation to a ski about a vertical axis, for retaining one end of the boot; a second holding element, releasable under the action of an abnormally high vertical load, for retaining the other end of the boot; a connecting element for connecting the boot to the ski, comprising a resilient element restoring the boot to its axial position upon the ski. One end of this connecting element is secured to the ski by means of the mobile element. The binding has the special advantage of allowing the binding to release under the action of a lateral load, while keeping the boot permanently connected to the ski.

25 Claims, 10 Drawing Figures

SAFETY BINDING FOR SKI BOOTS

The present invention relates to a safety binding for ski boots, more particularly to safety bindings for ski boots comprising an element connecting the boot to the ski, so that when the safety binding is released, the boot may leave the ski but may still remain attached thereto.

Safety bindings of this kind are known, the most advanced consisting of a stationary centering block integral with the ski and exhibiting a profile towards which a matching profile integral with the boot is urged by the connecting element. One end of this connecting element is accommodated in the stationary centering block, while the other end thereof is located in the profile integral with the boot.

The action of the element tends to keep the profiles fitted into each other.

A binding of this kind is described in patent application Ser. No. 235,119 filed on Mar. 16, 1972 and now U.S. Pat. No. 3,822,070.

It is an object of this invention to provide a binding having the advantages of known bindings, the binding being designed more particularly to provide a safety release in the event of an abnormally high lateral stress.

To this end, the binding according to the invention comprises:

- a first element which holds one end of the boot and is mobile in relation to the ski;
- a second element holding the other end of the boot;
- an element for connecting the boot to the ski and comprising a resilient element restoring the boot to an axial position on the ski.

According to one essential characteristic, the connecting element is attached to the ski by means of a mobile holding element, so that the connecting element comprising the resilient element tends to keep the end of the boot against the mobile holding element.

According to another characteristic of the invention, the cooperating profiles of the boot and the mobile holding element are such that any movement of the mobile holding element of the boot has the effect of increasing the tension of the resilient element and pressing the end of the boot against the mobile element.

Finally, according to still another essential characteristic of the invention, the end of the boot facing the mobile holding element is associated with a system of ramps which are disengaged from the stop integral with the ski whenever the boot pivots under the action of a lateral stress, so that this end of the boot is released from the binding.

This stop may be a part of the second holding element when the latter is attached to the ski. On the other hand, this stop may be separate from the holding element, especially when the latter is hinged in relation to the ski by means of links. This ramp and stop system preferably consists of a longitudinal housing into which a projecting ramp is fitted; but this ramp system may also be in any other form i.e. it may be hinged to the boot, or arranged to move along the boot, in which case it is actuated by the connecting element against the action of the resilient element.

According to still another characteristic of the invention, the mobile holding element preferably moves against the action of a resilient element. Moreover the mobile holding element may be mounted to pivot, in relation to the ski, about vertical axes or not, or it may slide in a transverse direction or not, or it may be hinged, or it may have any desired kind of complex movement.

As a result of this combination of devices, the binding according to the invention retains all of the advantages of a safety binding comprising a connecting element disigned to restore the boot to its longitudinal position. It also provides for special release of the binding under the action of an abnormally high lateral stress.

It will be observed that the resilient connecting element and the cooperating profiles of the boot and mobile holding element contribute to the lateral release of the binding, since the connecting element forces the boot to follow the movement of the mobile holding element, thus facilitating the disengagement of the ramp and stop system holding it by its other end. This applies more particularly when the boot is provided, under the sole, with a plate carrying a moving slide on which the ramp systems are mounted, or into which a system of hinged ramps retracts, the slide being actuated by the connecting element against the action of the resilient element. Reference to the figures will show more precisely that the movement of the mobile holding element is transmitted, through the connecting element, to the ramp system, thus allowing the end of the boot to be released from the stop which holds it. It is emphasized that the plate located under the sole of the boot may be:

- either permanently attached under or in the sole of the boot, in which case it it desirable to provide a fastening system making it possible to disconnect the connecting element from the boot;
- or temporarily attached to the boot, more particularly by a non-releasing ball-and-socket joint, or by the second releasable holding element.

A description will now be given of some nonrestrictive examples of embodiment of the invention, in conjunction with the drawings attached hereto, wherein.

Figure 1:
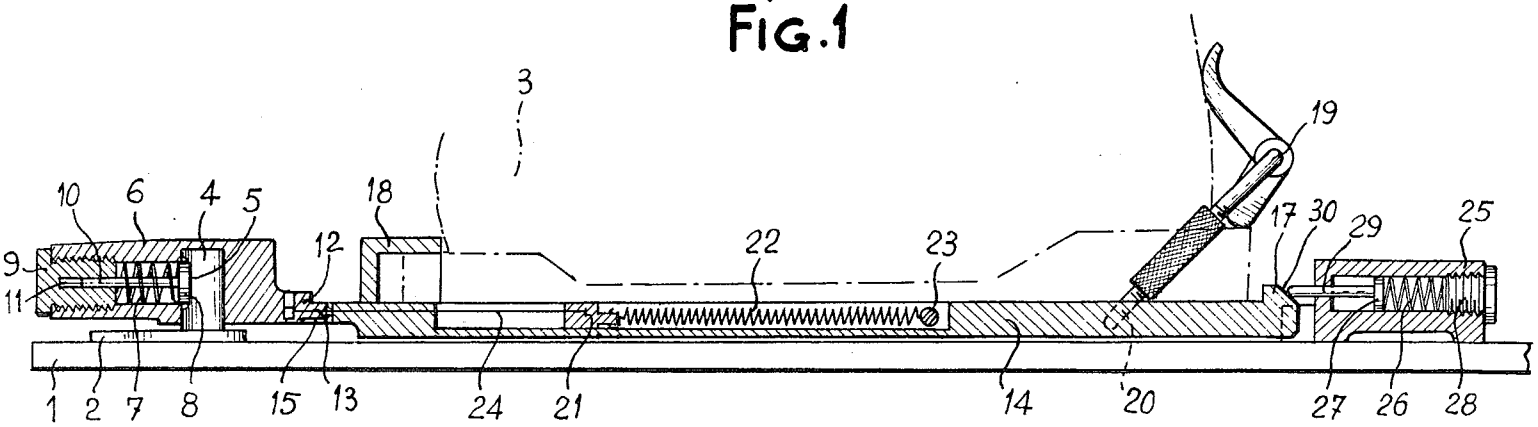
FIG. 1 is a longitudinal section through a first example of embodiment of a binding comprising a plate, with the boot in position.

A description will now be given of FIG. 1, which shows a longitudinal section through a first example of embodiment of a binding according to the invention.

Secured to ski 1 in front of boot 3, by means of screws, not shown, is a baseplate 2; this baseplate 2 has a vertical axis 4 having a flat portion 5. A member 6 rotates about this axis 4. This hollow member accommodates in its interior a resilient element 7, one end of which bears against a piston 8 stopped in its position of rest, against flat 5, while its other end bears against a threaded plug 9 screwed into member 6. Piston 8, actuated by resilient element 7, is guided in its longitudinal movement by a shaft 10 sliding in a housing 11 provided for this purpose in threaded plug 9. The front part of member 6 comprises a system of ramps 12 and projecting parts 13, the shape of which will be described in greater detail in conjunction with FIG. 2. This group of elements, located at the front end of the boot, constitutes the mobile holding element retaining the front end of the sale plate. A description will be given hereinafter of the way in which this mobile holding element brings about the release of the binding under the action of an abnormally high lateral stress.

Figure 2:
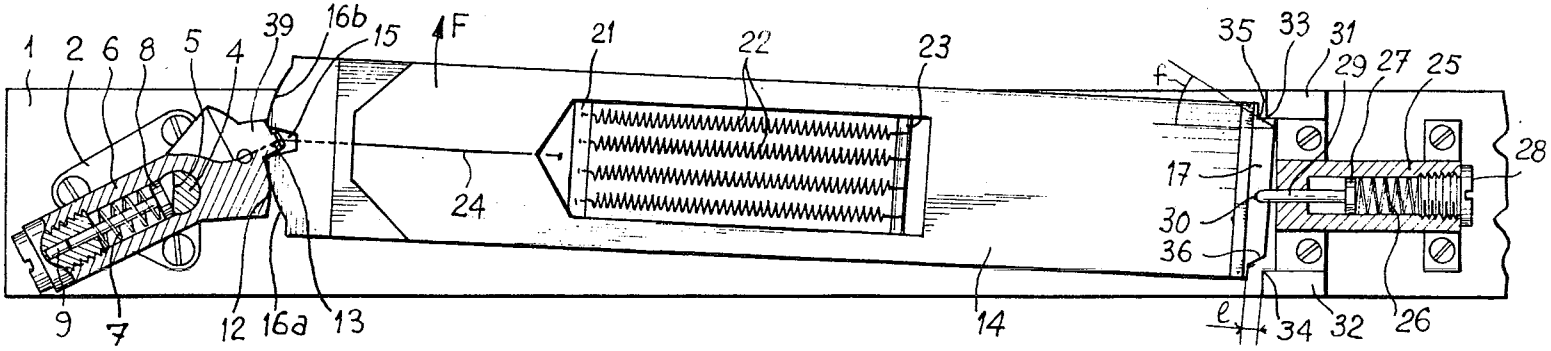
FIG. 2 is a partial section, through a plane parallel with the plane of the ski, showing a binding comprising a plate in which a slide runs, with the boot in position.

Located under the sole of boot 3 is a plate 14, the front end of which has a recess 15 designed to receive the projecting portion 13 of member 6 of the mobile holding element; the forward part of plate 14 also comprises a system of substantially circular ramps 16, seen better in FIG. 2. The rear part of plate 14 has a slopping ramp 17 cooperating with the second holding element located behind the boot, which will be described hereinafter. Boot 3 is secured to plate 14 temporarily, on the one hand, by an edge 18 located at the front end of the plate, under which the sole of the boot is engaged and, on the other hand, by a system of knuckle joints 19 hinged to plate 14 by links 20. This system of knuckle joints bears against the rear end of the sole of the boot. The central portion of plate 14 has a recess in which a slide 21 runs. This slide is actuated by a resilient element 22 consisting of coil springs mounted in parallel between slide 21 and a bar 23 integral with plate 14. This slide is connected to the mobile element located in front of the boot by a connecting element 24 consisting of a preferably metallic cable; to be more precise, slide 21 is connected by cable 24 to projecting portion 13 of member 6 of the mobile element.

Attached to the ski at the rear of the boot is a second holding element, comprising a member 25 secured to the ski. This member is hollow and contains a coil spring 26, one end of which bears against a piston 27, while the other end bears against a threaded plug 28 screwed into member 25. Piston 27, actuated by spring 26, is guided longitudinally by a shaft 29 sliding in a housing provided to this end in the forward part of member 25. End 30 of this shaft cooperates with slopping system of transverse ramps 17 located at the rear end of plate 14. Threaded plug 28 of the second holding element, and the threaded plug of the mobile holding element, are designed to provide continuous control over the tension of springs 7 and 26.

A description will now be given of this example of embodiment, the conjunction with FIG. 2, which shows a part section through the binding through a plane parallel to the plane of the ski.

The binding is shown in the lateral-release position. Most of the elements will be recognized from FIG. 1, and the same reference numerals are used. It will be noted that ramps 12 and 16, integral respectively with member 6 of the mobile holding element and the front end of plate 14, bear against each other. Ramp 12 is substantially circular and is centered on vertical axis 4. Projecting portion 13, located on the longitudinal axis of member 6, engages in recess 15 along the longitudinal axis of plate 14. Ramp 16, integral with plate 14, consists of half ramps 16*a*, 16*b* which are substantially circular and are centered respectively on parts 33 and 36 of the plate, which will be defined hereinafter.

Member 6 of the mobile holding element comprises, above ramp 12 and projecting portion 13, a shoulder 39 designed to prevent the front end of the plate from lifting under the action of a vertical load.

Distance *l* between the rear end of plate 14 and the second element holding the rear end of the boot, and the length of ramp 17 also, are such as to allow the ski to flex. More particularly, the length of ramp 17 is less than the depth of the recess formed by shoulders 31, 32. It will be observed, however, that, when the ski flexes, ramp 17 pushes piston 27 back against the action of spring 26. It will be seen that this brings about an increase in the vertical release load.

Ramp 17 is engaged in a recess integral with member 25 of the second holding element. This longitudinal recess is formed by two shoulders 31, 32 integral with member 25 and located on each side thereof. Edges 33, 34 of this recess are rounded off in order to allow the plate to rotate in the event of lateral release. In order to facilitate rotation of the plate, sides 35, 36 of ramp 17 are inclined at an angle *f*.

A description will now be given of the operation of this example of embodiment of a binding according to the invention.

Release of the binding under the action of an abnormally high vertical load is known per se. To recapitulate briefly, as the skier's heel rises, it lifts plate 14 which, by means of ramp 17, pushes back stop 30, against which it bears as it compresses spring 26. It will easily be perceived that, if a sufficiently high load is applied, ramp 17 will free itself from the stop, allowing the boot to leave the binding, but that the boot will remain attached to the ski by connecting element 24.

Under lateral stress in the direction of arrow F, the boot and the plate pivot about an effective axis located substantially below the skier's heel, to be more precise, in the vicinity of edge 33 of the recess.

Rotation of the plate in the direction of arrow F causes member 6 of the mobile holding element to rotate against the action of coil spring 7, and projecting portion 13 integral with member 6, engaged in recess 15 of plate 14, cooperates with the latter like a gear. The profiles of ramps 12 and 16 integral with member 6, of the mobile holding element, and of plate 14, are such that, on the one hand, resilient element 22 is placed in tension by connecting element 24 and, on the other hand, plate 14, or more particularly side 36 of ramp 17, moves slightly towards the front of the ski. In the event of a sufficiently large angle of rotation, i.e. an abnormally high lateral load, side 36 of ramp 17 disengages from the recess formed by shoulder 32. The release lug, in the case of a lateral load in the direction of arrow F, is formed by edge 34 of shoulder 32. Thus, as soon as edge 36, which slides along rounded edge 34, escapes therefrom, the boot and the plate are free.

It will be observed that the profiles of ramps 12 and 13, which are designed to place resilient element 22 in tension, assist in keeping the front edge of plate 14 constantly against the moving element. The result of this is that the plate will tend to move forwards and accompany the rotary movement of member 6 of the mobile holding element.

In the case of this example of embodiment, the boot is made temporarily integral with plate 14 by means of a knuckle-joint system 19. It will be seen that plate 14 could be permanently secured to or in the sole of the boot, since the vertical release element is hinged between the ski and the plate. Preferably, however, in the latter case, the connecting element would have a detachable hooking system, to allow the skier to remove his skis in order to walk in the snow.

Figure 3:
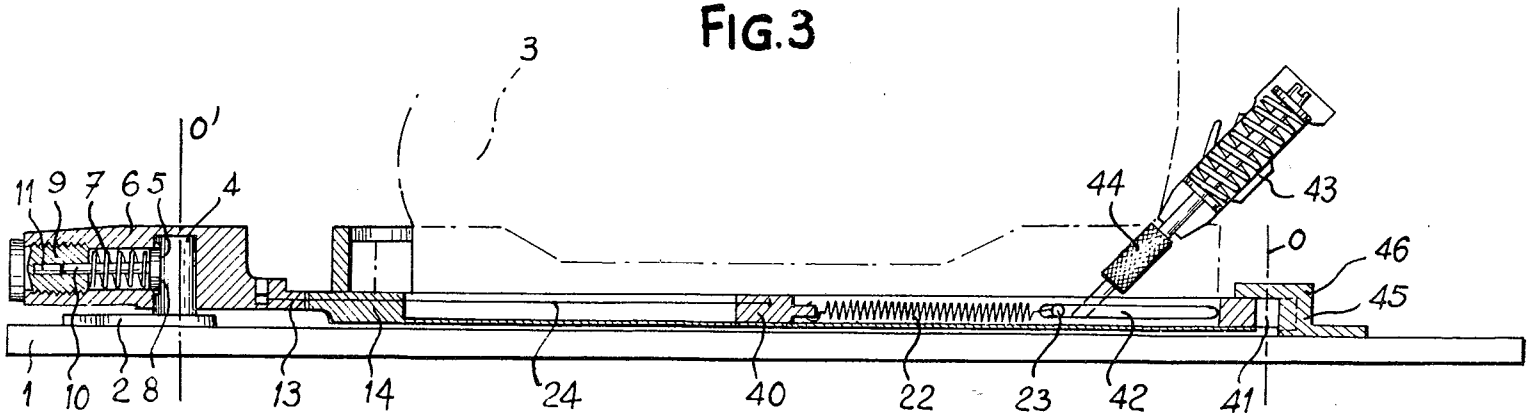
FIG. 3 is a longitudinal section through a second example of embodiment of a binding comprising a plate, with the boot in position.

A description will now be given of FIG. 3 which shows a longitudinal section through a second embodiment of the binding according to the invention.

Some of the elements described in conjunction with FIGS. 1 and 2 will be recognized in this figure, especially the mobile holding element located on front of the boot rotating about axis O', and plate 14 temporarily secured to the sole of the boot.

In this example of embodiment, slide 40, running inside the plate, is extended towards the rear by a ramp system 41; thus U-shaped ramp 41, open towards the heel of the ski and formed by a semi-circular profile with its axis at right angles to the plane of the plate, is located along the longitudinal axis of the said plate.

Slide 40 also has a slot 42 for the passage of bar 23 integral with plate 14 on which is mounted one of the ends of springs 22.

In this example of embodiment, the holding element designed to retain the rear end of the boot consists, on the one hand, of a heel-piece 43 mounted on links 44 hinged in relation to plate 14; this heel-piece is designed to effect a safety release under the action of an abnormally high vertical load. Since the heel-piece is known per se, it will not be described here in detail. The element holding the rear end of the boot consists, on the other hand, of a stop 45 secured to the ski by means of screws, not shown. This stop 45 comprises an edge 46 bearing on the top surface of the slide. As a variant, this edge could bear on the top surface of plate 14.

This edge 46 is designed to keep the plate against the ski and to prevent it from lifting under the action of a vertical load. Stop 45 also comprises a ramp system 47 which will be described in greater detail in conjunction with FIG. 4. This ramp system is designed to cooperate with ramps 41 integral with slide 40.

Figure 4:
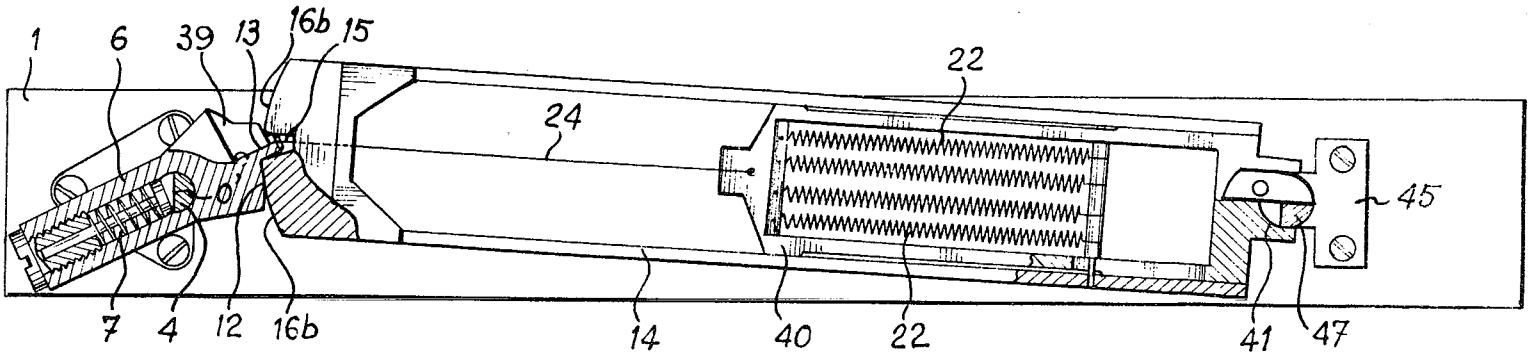
FIG. 4 is a partial section, through a plane parallel with the plane of the ski, in the lateral-release position, of the example of embodiment illustrated in FIG. 3.

A description will now be given of FIG. 4, which is a part section through a plane parallel with the plane of the ski in the example of embodiment illustrated in FIG. 3.

The binding is shown in the lateral-release position. Most of the elements described in conjunction with FIG. 3 and the preceding figures will be recognized, especially plate 14 with slide 40 and the mobile holding element located in front of the boot. Ramp 47, integral with stop 45, is substantially semi-circular and is centered on an axis O at right angles to the plane of the ski. The diameter of semi-circular ramp 47 is substantially equal to the diameter of ramp 41 integral with slide 40.

A description will now be given of the operation of this variant of the binding according to the invention.

In the event of a lateral load, plate 14 pivots about vertical axis O, being guided in this rotary motion by semi-circular ramps 41 and 47 which cooperate. The plate pivots laterally against the action of spring 7 of the mobile holding element. As in the variant described above, ramps 12 and 16 are designed to place springs 22 in tension by means of connecting element 24, ramp 12 being substantially centered upon axis of rotation O' of the mobile element, and ramp 16 being centered on axis O. Slide 40 runs within plate 14 in a forward direction, carrying along ramps 41. In the event of a sufficiently large angle of rotation, i.e. a sufficiently high lateral load, the slide advances by an amount such that ramps 41 to 47 cease to cooperate. This allows the plate and the boot to turn freely under the action of the torsion couple. It will be observed that the lateral release lug on ramp 47 is located on the same side of the ski as the direction of rotation of the boot.

When the ski flexes, the distance between axis O and O' decreases; since semi-cylindrical profiles 41 and 47 do not allow the one to move longitudinally in relation to the other, slide 40 must inevitably move in plate 14 against the action of springs 22. The portion of the lateral-release load applied by these springs 22 is small, and flexion of the ski therefore has practically no effect upon this lateral-release load. It is emphasized that a sliding housing may be provided at the rear if the springs of the slide are not to be compressed when the ski flexes.

The means for refitting the plate to the ski have not been described, in order to simplify the description; moreover they are subordinate to this present invention. It will merely be pointed out that it would be sufficient, for example, to mount stop 45 on a part which slides in relation to the ski, in order to make it possible to refit the binding. A refitting device of the step-in type could also be achieved by providing the slide with ramps cooperating with ramps on the ski against the action of springs 22 in the said slide.

Figure 5:
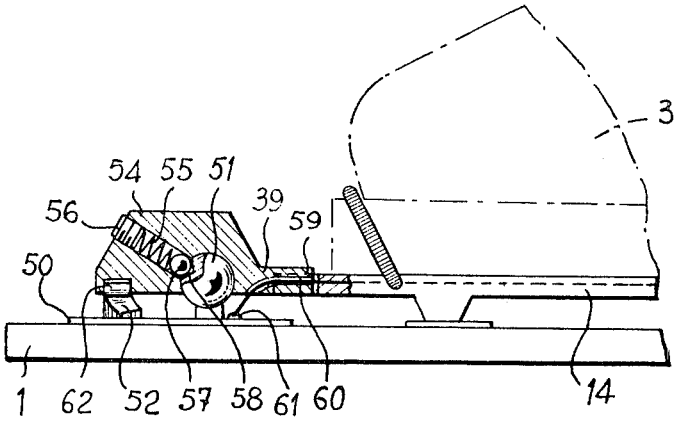
FIG. 5 shows a detail, in longitudinal section, of an example of embodiment of the mobile holding element, with the boot in position.
Figure 6:
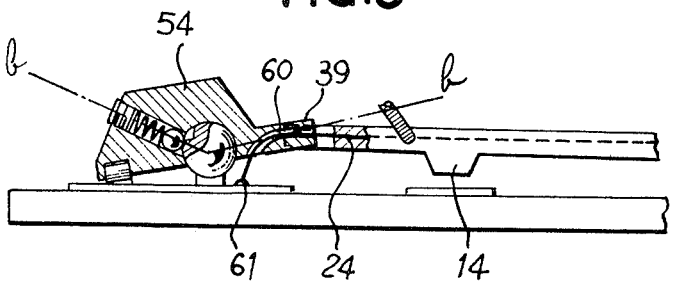
FIG. 6 is a section, through vertical plane aa, of the detail illustrated in FIG. 5, in the lateral-release position.
Figure 7:
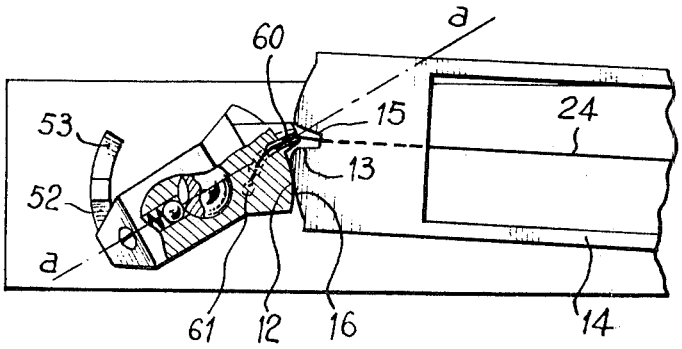
FIG. 7 is a section, through transverse plane *bb*, of the detail illustrated in FIG. 5, in the lateral-release position.

A description will now be given of FIGS. 5, 6 and 7 which show details, in longitudinal section, of a variant of the mobile holding element.

The mobile holding element in these figures has been described in patent application Ser. No. 516,422 filed on Oct. 21, 1974 and now U.S. Pat. No. 3,909,029.

It comprises a baseplate 50 secured to ski 1 by means of screws, not shown, and comprising a spherical joint 51 and a system of ramps 52–53 sloping towards the sides of the ski and arranged symmetrically in relation to the longitudinal plane of symmetry of the ski. It comprises internally a resilient element 55, one end of which bears against a threaded plug 56 screwed into the body, while the other end bears on a ball 57 designed to lock member 54 in relation to spherical joint 51, by means of a recess 58 defined by ramps and provided, to this end, in spherical joint 51.

End 59 of member 54, designed to cooperate with the front end of the plate by means of ramp systems 12, 13, 15, 16, is pierced by a passage 60 located on the longitudinal axis of the member. Connecting cable 24, which attaches plate 14 and boot 3 to ski 1, passes through this passage and is secured to the ski at point 61 on the longitudinal axis of the ski. Plate 14 and boot 3 are therefore connected directly to ski 1 by member 54 of the mobile element.

The holding element located at the rear end of the boot has not been shown. It may be of the type described in conjunction with FIGS. 1, 2, 3 and 4, or of a quite different type.

A description will now be given of the operation of this variant.

In the event of a lateral load, the boot pivots substantially about an axis located under the skier's heel, carrying along member 54, as described hereinbefore. Ramp system 52–53, integral with the ski, guides the rotary motion of member 54 which bears against the said ramps through a roller 62. It will be observed, with particular reference to FIG. 6, that ramp system 52–53 allows member 54 to rock slightly, so that plate 14 pivots and lifts if any stresses exist which would tend to pull the foot into alignment with the leg.

It will be observed that this rocking movement of member 54 in a vertical plane allows the binding to release under the action of a vertical load in a forward direction, after the mobile holding element has rotated through a certain angle. In other words, this present holding element cannot release under the action of a vertical load until member 54 has pivoted through a certain angle under the action of a lateral load.

Figure 8:
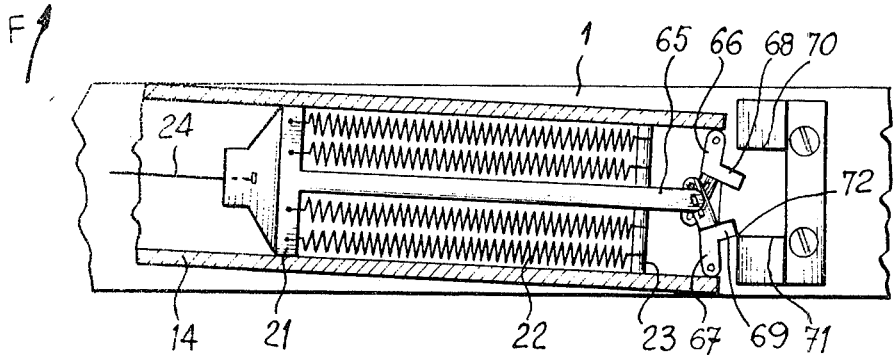
FIG. 8 is a partial section, through a plane parallel with the plane of the ski, showing an example of embodiment of the ramp and stop system, in the lateral-release position.

A description will now be given of FIG. 8, which is a section, through a horizontal plane, showing a detail of a variant of the ramp and stop system, holding the rear end of the plate integral with the boot. Some of the elements described in conjunction with the preceding figures will be recognized, especially plate 14 and slide 21 moving longitudinally within the plate and actuated by connecting cable 24 against the action of coil springs 22.

This slide 21 has a longitudinal shaft 65, the rear end of which cooperates with two levers 66, 67 hinged, in relation to plate 14, about two axes at right angles to the plane of the said plate. The ends of these levers are provided with slots in which there slides a catch integral with the end of longitudinal shaft 65, in order to allow the levers to pivot when they are actuated by shaft 65. These levers have two bent arms 68, 69 bearing, when the boot is fitted, against two sides 70, 71 secured on each side of the ski. When the boot pivots under the action of a lateral load and carries the plate along, connecting element 24 actuates slide 21 as described hereinbefore. Slide 21 advances, carrying along levers 66, 67 which retract into plate 14. As soon as bent arm 69 ceases to bear against side 71, the rear end of the plate can pivot freely and release itself from the binding. It will be observed that, for a lateral load in the direction of arrow F, the release lug is located at 72 on side 71.

An edge not shown, integral with the ski, prevents the plate from lifting under the action of a vertical load.

Figure 9:
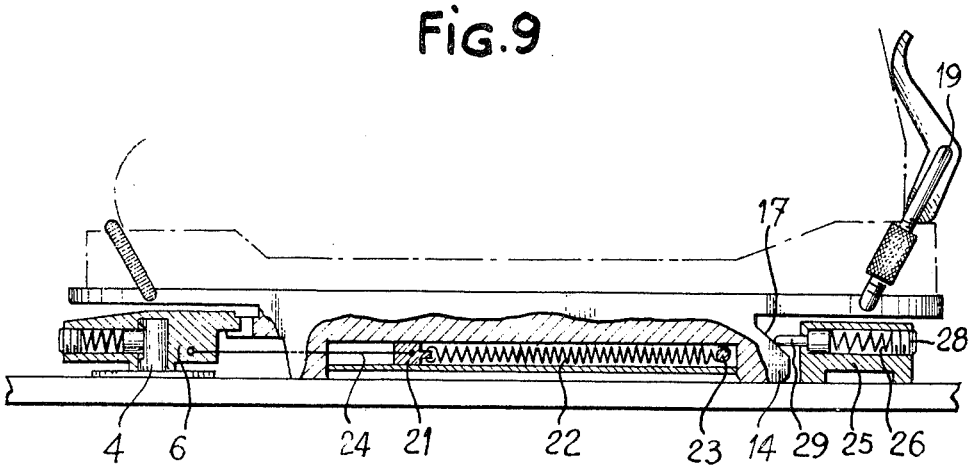
FIG. 9 is a partial longitudinal section through another example of embodiment, the holding elements being located under the sole of the boot.
Figure 10:
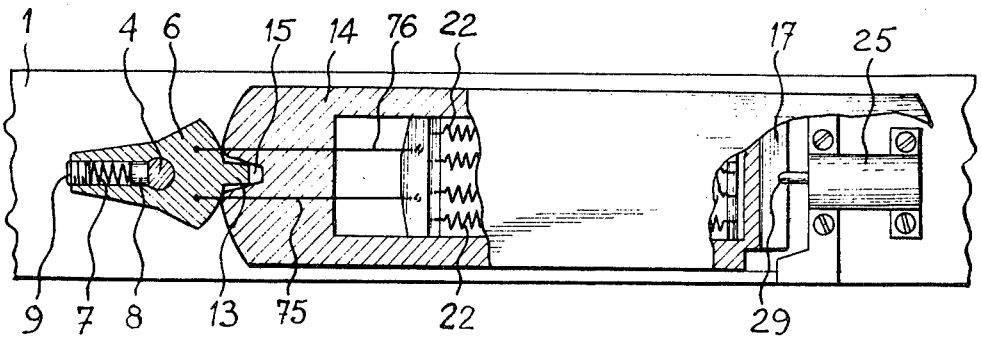
FIG. 10 is a partial section, through a plane parallel with the plane of the ski, showing the plate and the holding elements of the example of embodiment illustrated in FIG. 9.

A description will now be given of FIGS. 9 and 10 which illustrate respectively a longitudinal section and a part section, through a plane parallel with the plane of the ski, of a variant of the binding according to the invention.

Most of the elements described in conjunction with the preceding figures will be recognized, and these elements bear the same reference numerals.

In this variant, it will be noted that the plate consists of two cables 75, 76 arranged symmetrically in relation to the longitudinal axis of the ski. Moreover the dimensions of the two holding elements are such that they may be located under the sole of the boot, in housings provided for the purpose in the thickness of plate 14.

What is claimed is:

1. In combination, a ski and a safety binding device for a ski boot, said device comprising: a ski boot element; a first mobile holding element mounted on said ski for retaining one end of said ski boot element said first holding element being laterally pivotable; a second holding element for retaining the other end of said ski boot element; connecting means permanently attaching said ski boot element to said ski, through said first holding element, whereby, when the safety binding device releases, although said ski boot element may move away from the ski, it will still remain attached thereto; said connecting means including resilient means; said ski boot element and said first holding element each including contacting cooperating profile means, said profile means being adapted to increase the tension of said resilient means of said connecting means when said first holding element moves laterally under the action of said ski boot element whereby said ski boot element is returned in alignment with said first holding element when the lateral load is insufficient to release the binding device.

2. A safety binding according to claim 1, wherein said mobile holding element moves against the action of a resilient system.

3. A safety binding for a ski boot according to claim 2, said boot element including a plate mounted to the sole of a ski boot; said cooperating profile means of said boot element being located on said plate, said connecting means connecting said plate to the ski through said mobile holding element.

4. A safety binding according to claim 2, comprising means pivotally mounting on said ski said mobile holding element in relation to a center of rotation mounted on said ski.

5. A binding according to claim 4, wherein one end of said connecting means is secured to the ski, said connecting means sliding in a passage provided for the purpose in said mobile holding element.

6. A safety binding according to claim 4, the cooperating profile of said mobile holding element comprising two lateral parts substantially circular and centered on said center of rotation.

7. A safety binding according to claim 6, the cooperating profile means of said mobile holding element also comprising, in its central portion, a projecting part adapted to engage in a recess provided in said boot element.

8. A safety binding according to claim 7, the cooperating profile of said boot element comprising, on each side of said recess, two parts which are substantially circular and are centered on a center of rotation of said boot element when it moves in relation to the ski.

9. A safety binding according to claim 8, wherein the cooperating profile means of said mobile holding element comprises, above said projecting part, a shoulder means preventing the corresponding end of said boot element from lifting.

10. A safety binding according to claim 1, further comprising stop means associated with said second holding element for holding said other end of said ski boot element transversally, said stop means being mounted on said ski.

11. A binding according to claim 10, wherein one end of said plate remote from said mobile holding element comprises a ramp cooperating with said stop means.

12. A safety binding according to claim 11, further comprising means for releasing the other end of said ski boot element from said stop means, said releasing means comprising said cooperating profile means which are further effective for guiding said plate moving towards said mobile holding element when said mobile holding element moves under the action of a lateral load applied by said ski boot element.

13. A binding according to claim 11, wherein said second holding element is interposed between the boot element and the plate, said stop means mounted on the ski also comprising an edge designed to hold said plate against the ski, so that said plate cannot lift under the action of a vertical load.

14. A binding according to claim 11, wherein said stop means comprises a recess into which said other end of said ski boot element fits.

15. A binding according to claim 14, wherein the edges of said recess are rounded off to allow the boot element to rotate in the event of a lateral release.

16. A binding according to claim 15, wherein the depth of said recess is greater than the length of said ramp, in order to allow the ski to flex.

17. A safety binding according to claim 10, wherein said cooperating profile means and said cooperating means cooperate to release the other end of said ski boot element from said stop means and to guide said ski boot element towards said first holding element when said first holding element moves under the action of a lateral load applied by said ski boot element whereby said other end of said ski boot element is freed from said stop means when said lateral load applied by said ski boot element is abnormally high.

18. A safety binding as defined in claim 10, wherein said ski boot element comprises a mobile ramp system for releasing said other end of said ski boot element from said stop means; said ramp system being movable longitudinally with respect to said other end of said ski boot element; said mobile ramp system cooperating with said stop means and being actuated by said connecting means when the first holding element moves whereby said other end of said ski boot element is freed from said stop means when a lateral load applied by said ski boot element is abnormally high.

19. A safety binding according to claim 18 wherein said ski boot element includes a plate adapted to be mounted to the sole of a ski boot; said cooperating profile means of said ski boot element being located on said plate; the end of said plate remote from said mobile holding element including said mobile ramp system; said connecting means, connecting said plate to said ski through said mobile holding element, being attached to said mobile ramp system.

20. A safety binding according to claim 19, wherein said mobile ramp system is located on a slide mounted inside said plate, mobile with respect to said plate.

21. A binding according to claim 20, wherein one end of said resilient means is secured to said plate, while the other end is secured to said slide.

22. A binding according to claim 20, wherein said stop means secured to the ski is semi-cylindrical, said ramp system integral with the slide is a U-shaped recess formed by a semi-circular profile of the same diameter as that of the stop means.

23. A binding according to claim 19, wherein said mobile ramp system is hingedly mounted about a least one axis normal with respect to said plate.

24. A binding according to claim 23, wherein one end of said resilient means is secured to said plate, while the other end is secured to said connecting means.

25. A safety binding according to claim 1, further comprising means for releasing the other end of said ski boot element from said stop means, said releasing means comprising said cooperating profile means which are further effective for guiding said ski boot moving towards said mobile holding element when said mobile holding element moves under the action of a lateral load applied by said ski boot element; a ramp system mobile with respect to said other end of said ski boot element; said mobile ramp system cooperating with said stop means and being actuated by said connecting means whereby said other end of said ski boot element is freed from said stop means when a lateral load applied by the ski boot element is abnormally high.

* * * * *